United States Patent [19]

Pui

[11] 3,971,016

[45] July 20, 1976

[54] ELECTRONIC CHIRPER

[75] Inventor: Fong Pui, Kennedy Town, Hong Kong

[73] Assignee: Playart Ltd., Hong Kong

[22] Filed: Mar. 3, 1975

[21] Appl. No.: 554,766

[30] Foreign Application Priority Data

Apr. 22, 1974 United Kingdom ..... 17597/74

[52] U.S. Cl. ..... 340/384 E; 340/384 R

[51] Int. Cl.[2] ..... G08B 3/10

[58] Field of Search ..... 340/384 E, 384 R; 331/107, 117

[56] References Cited

UNITED STATES PATENTS 3,707,716 12/1972 Goralnick ..... 340/384 E

*Primary Examiner*—Harold I. Pitts

*Attorney, Agent, or Firm*—Wood, Herron & Evans

[57] ABSTRACT

An audio frequency signal generating circuit for producing repeated tones that includes a pair of transistors. The first transistor has its collector connected to a voltage supply line, has a capacitor connected between its emitter lead and earth, and also has an inductance connected to its emitter lead. The collector of the second transistor is connected to the other side of the inductance and the emitter is connected to the other side of the supply. The first transistor has biasing means to bias it into an operating condition and the second transistor is arranged with reactive feedback to cause oscillation.

8 Claims, 2 Drawing Figures

ELECTRONIC CHIRPER

SUMMARY OF THE INVENTION

This invention relates to electronic devices for producing repeated audio tone signals.

An audio frequency signal generator for producing repeated audio frequency tones in accordance with the invention comprises a pair of transistors, the first transistor having its collector connected to a voltage supply line and having a capacitor connected between its emitter lead and earth, and also having a inductance connected to its emitter lead, the collector of the second transistor being connected to the other side of the inductance and the emitter being connected to the other side of the supply, the first transistor having biasing means to bias it into an operating condition and the second transistor being arranged with reactive feedback to cause oscillation.

Preferably the biasing means for the first transistor comprises a resistive shunt feedback loop.

Preferably the inductance and part of the reactive feedback comprise the primary winding of a transformer whose secondary is connected to a loudspeaker.

The first transistor preferably has resistive shunt feedback so arranged that when the supply is switched on, it immediately begins to conduct. The capacitor connected to its emitter, which is initially discharged, then begins to charge so that the emitter voltage increases rapidly from zero towards the supply voltage. When it has risen to a certain level the second transistor begins to conduct so that the capacitor starts to discharge through it and the inductance in the collector circuit of the second transistor and the reactive feedback cause the process to continue in an oscillatory manner.

The oscillation caused by the generator produces a "warbling" effect when fed to a loudspeaker. This effect may be altered by switchable feedback loops, including resistors, capacitors and inductors of various sizes.

Preferably the generator is housed in a casing, which may be in the shape of a bird, push-button switches being provided for the various feedback loops.

BRIEF DESCRIPTION OF THE DRAWINGS

The invention will now be further described by way of example, with reference to the accompanying drawings, in which.

DESCRIPTION OF THE PREFERRED EMBODIMENT

Figure 1:
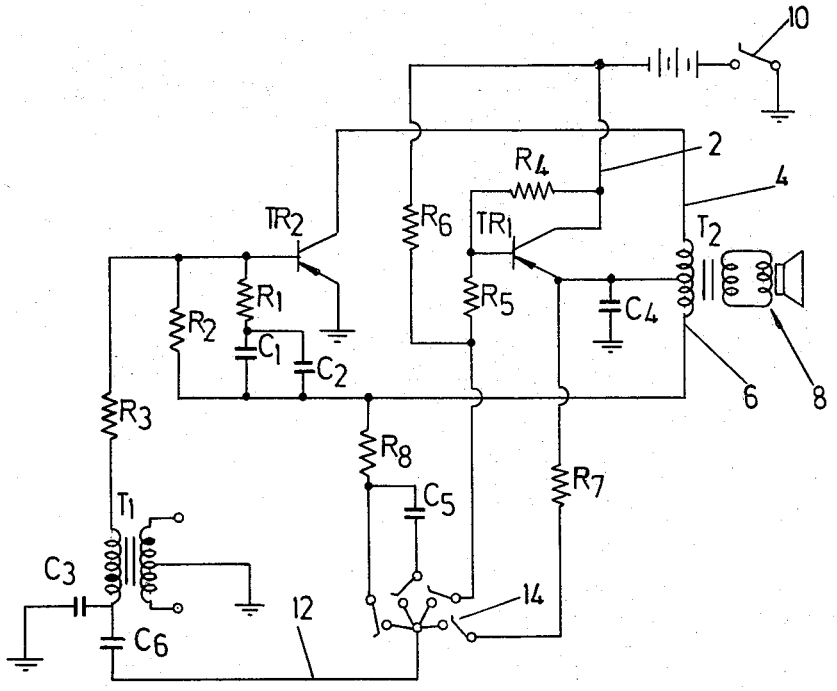
FIG. 1 is a circuit diagram of a generator in accordance with the invention.

Referring to FIG. 1, the collector of a transistor TR1 is connected via a line 2 to a 9V supply and the base and collector are connected by a shunt feedback network consisting of resistances R4, R5 and R6. The emitter of TR1 is connected to the centre tap of the primary winding of a transformer T2, and also to a capacitor $C_4$ which in use is charged up and discharged to zero volts alternately to produce a varying output signal.

One side 4 of the transformer primary is connected to the collector of another transistor TR2 whose emitter is connected to earth. The other side 6 of the primary is connected via resistors R1 and R2 and capacitors C1 and C2 to the base of transistor TR2, so as to form a reactive shunt feedback loop. The secondary of the transformer is connected to a loudspeaker 8.

When a supply switch 10 is closed, the transistor TR1 is biased into conduction owing to the shunt feedback network comprising $R_4$, $R_5$ and $R_6$, and to the connection of capacitor $C_4$ (which is initially discharged) between its emitter and earth. The capacitor $C_4$ therefore begins to charge up through the collector-emitter path of TR1 so that the voltage at the centre tap of T2 rises. The voltages at the sides 4 and 6 of the primary also begin to rise and since they are connected respectively to the collector and (via a feedback network) the base of TR2, this also begins to conduct, so that the capacitor $C_4$ begins to discharge.

Owing to the inductance of T2 and the feedback arrangement, a cyclic process of charging and discharging $C_4$ then takes place resulting in a "warbling" tone being emitted from the speaker 8.

The feedback around the circuit can be altered by means of a number of switches 14 connected to a line 12, which is connected via a capacitor $C_6$, inductor $T_1$, and resistor $R_3$ to the base of TR2. Operation of these switches causes the line 12 to be connected to (a) the shunt feedback loop of TR2 via a resistor R8; or (b) the same feedback loop via a capacitor $C_5$ and resistor R8; or (c) the feedback loop of TR1 or (d) the emitter of TR1 via a resistor R7.

A further capacitor $C_3$ is connected between the junction of the transformer $T_1$ and capacitor $C_6$, and ground, so that when the line 12 is connected into the circuit through one of the switches 14, this capacitor is also alternately charged and discharged so as to cause oscillation at various different frequencies, depending on which resistors are connected in series with it and their positions in the circuit.

In the preferred embodiment of the invention which is designed to produce bird-like chirping noises, the components have the following values;

$TR_1$, $TR_2$ = 25B77 or 25B187
$T_1$ 32 8K:3K
$T_2$ = 450: 8
R1, R5, R8 = 1KΩ
R2 = 47KΩ
R3 = 1.8KΩ
R4 = 10KΩ
R6 = 4.7KΩ
R7 = 2.4KΩ
C1 = 0.0022MFD
C2 = 0.022MFD
C3, C5 = 5MFD
C4 = 1MFD
C6 = 47 MFD

Figure 2:
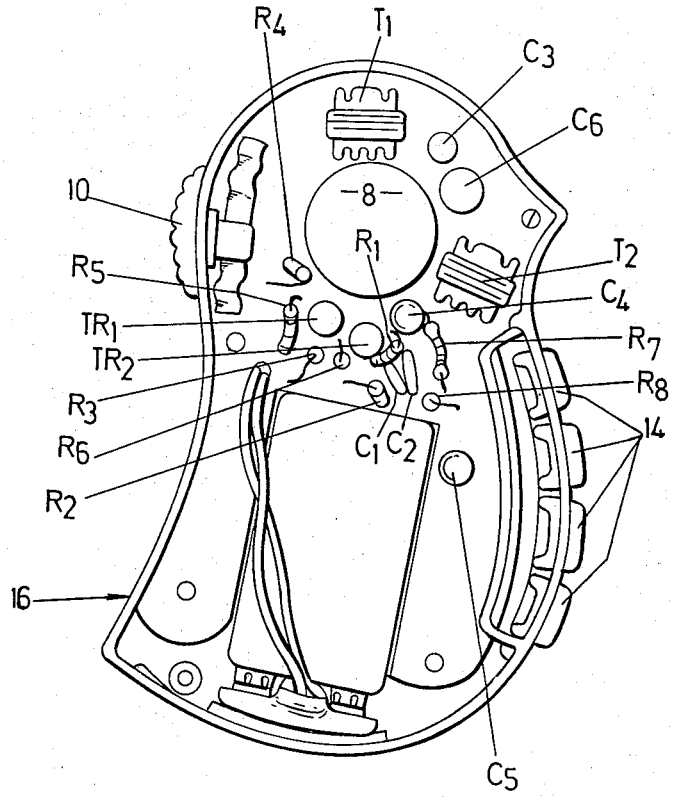
FIG. 2 is a plan view showing the arrangement of the components of the generator in a casing in the shape of a bird.

Referring to FIG. 2, a bird-shaped casing for the generator is indicated generally at 16. Supply switch 10 and push-button switches 14 are shown on the outside of the casing 16.

Closing of switch 10 caused the warbling sound to be emitted from loudspeaker 8, the tone and frequency of the sound being altered by switches 14.

We claim:

1. An audio frequency signal generating circuit for producing repeated tones comprising a pair of transistors, the first transistor having one of its collector and emitter connected to a voltage supply line, having a capacitor connected between the other of its collector and emitter and the other side of the supply, and also having an inductance connected to that other of its collector and emitter, the second transistor having one of its collector and emitter connected to the other side of the inductance, and having the other of its collector and emitter also connected to the other side of the supply, the first transistor having biasing means to bias it into an operating condition and the second transistor being arranged with reactive feedback to cause oscillation.

2. A circuit as claimed in claim 1 in which the biasing means for the first transistor comprises a resistive shunt feedback loop.

3. A circuit as claimed in claim 1 in which the emitter of the first transistor is connected to a centre tap of an inductor winding, one half of the winding being connected to the collector of the second transistor and the other half of the winding comprising the reactive feedback of the second transistor.

4. A circuit as claimed in claim 3 in which the inductor winding comprises the primary of a transformer and a loudspeaker is connected to the secondary of the transformer.

5. A circuit as claimed in claim 3 in which the feedback loop of the second transistor further comprises a resistor/capacitor network.

6. A circuit as claimed in claim 1 further comprising a resistor, inductor and capacitor connected in series to the base of the second transistor, a further capacitor being connected between the junction of the series connected capacitor and inductor, and earth, and selectively operable switch means being provided to connect the other side of the series connected capacitor to at least one other part of the circuit so as to provide additional feedback to change the frequency of oscillation.

7. A circuit as claimed in claim 6 in which the switch means is arranged to connect the series connected capacitor either to the reactive feedback loop of the second transistor or the biasing circuit of the first transistor, or to the emitter of the first transistor.

8. A circuit as claimed in claim 6 having an outer casing in the general shape of a bird and having a number of push-button contacts for altering the warbling effect.

* * * * *